US010407628B2

(12) United States Patent
Bellussi et al.

(10) Patent No.: US 10,407,628 B2
(45) Date of Patent: Sep. 10, 2019

(54) PROCESS FOR THE REFINING OF CRUDE OIL

(71) Applicant: ENI S.p.A., Rome (IT)

(72) Inventors: Giuseppe Bellussi, Piacenza (IT); Vincenzo Piccolo, Zelo Buon Persico (IT); Alberto Maria Antonio Malandrino, Milan (IT); Valentina Fabio, Catanzaro (IT); Giacomo Fernando Rispoli, Rome (IT)

(73) Assignee: ENI S.p.A., Rome (IT)

( * ) Notice: Subject to any disclaimer, the term of this patent is extended or adjusted under 35 U.S.C. 154(b) by 33 days.

(21) Appl. No.: 14/902,204

(22) PCT Filed: Jul. 4, 2014

(86) PCT No.: PCT/IB2014/062855
§ 371 (c)(1),
(2) Date: Dec. 30, 2015

(87) PCT Pub. No.: WO2015/001520
PCT Pub. Date: Jan. 8, 2015

(65) Prior Publication Data

US 2016/0369181 A1 Dec. 22, 2016

(30) Foreign Application Priority Data

Jul. 5, 2013 (IT) ..... MI2013A001137

(51) Int. Cl.
*C10G 65/00* (2006.01)
*C10G 45/02* (2006.01)
(Continued)

(52) U.S. Cl.
CPC ..... *C10G 65/00* (2013.01); *C10G 7/00* (2013.01); *C10G 7/06* (2013.01); *C10G 45/02* (2013.01);
(Continued)

(58) Field of Classification Search
CPC ..... C10G 65/00; C10G 65/02; C10G 65/12; C10G 65/14; C10G 65/16; C10G 45/02;
(Continued)

(56) References Cited

U.S. PATENT DOCUMENTS 4,209,383 A * 6/1980 Herout ..... C10L 1/06 208/93
4,435,280 A * 3/1984 Ranganathan ..... C10G 47/26 208/107
(Continued)

FOREIGN PATENT DOCUMENTS

KZ 25186 B 12/2011
KZ 25301 A4 12/2011
(Continued)

OTHER PUBLICATIONS

International Search Report dated Sep. 18, 2014 in corresponding PCT/IB2014/062855.
(Continued)

*Primary Examiner* — Prem C Singh
*Assistant Examiner* — Brandi M Doyle
(74) *Attorney, Agent, or Firm* — Oblon, McClelland, Maier & Neustadt, L.L.P.

(57) ABSTRACT

A process for the refining of crude oil with at least one atmospheric distillation unit for separating the various fractions, a sub-atmospheric distillation unit, a conversion unit of the heavy fractions obtained, a unit for enhancing the quality of some of the fractions obtained by actions on the chemical composition of their constituents and a unit for the removal of undesired components, where the sub-atmospheric distillation residue is sent to one of the conversion units, the conversion unit includes at least one hydroconversion reactor in slurry phase, into which hydrogen or a mixture of hydrogen and $H_2S$, is fed, in the presence of a
(Continued)

suitable dispersed hydrogenation catalyst with dimensions ranging from 1 nanometer to 30 microns.

9 Claims, 4 Drawing Sheets

(51) Int. Cl.

| | |
|---|---|
| ***C10G 47/26*** | (2006.01) |
| ***C10G 49/12*** | (2006.01) |
| ***C10G 65/12*** | (2006.01) |
| ***C10G 65/14*** | (2006.01) |
| ***C10G 65/16*** | (2006.01) |
| ***C10G 7/00*** | (2006.01) |
| ***C10G 7/06*** | (2006.01) |

(52) U.S. Cl.
CPC ..... *C10G 47/26* (2013.01); *C10G 49/12* (2013.01); *C10G 65/12* (2013.01); *C10G 65/14* (2013.01); *C10G 65/16* (2013.01); *C10G 2300/202* (2013.01); *C10G 2300/308* (2013.01)

(58) Field of Classification Search
CPC ..... C10G 47/02; C10G 47/26; C10G 49/12; C10G 2300/202; C10G 2300/308
See application file for complete search history.

(56) References Cited

U.S. PATENT DOCUMENTS

| | | | | |
|---|---|---|---|---|
| 6,436,279 | B1 * | 8/2002 | Colyar | C10G 45/16 208/107 |
| 9,677,015 | B2 * | 6/2017 | Gupta | C10G 65/02 |
| 2005/0241993 | A1 | 11/2005 | Lott et al. | |
| 2008/0011643 | A1 * | 1/2008 | Lenglet | C10G 67/00 208/58 |
| 2009/0288984 | A1 * | 11/2009 | Colyar | C10G 11/16 208/49 |
| 2009/0326304 | A1 | 12/2009 | Bhattacharyya et al. | |
| 2010/0329935 | A1 * | 12/2010 | McGehee | C10G 47/00 422/140 |
| 2013/0277274 | A1 | 10/2013 | Rispoli et al. | |
| 2014/0291203 | A1 * | 10/2014 | Molinari | B01J 27/051 208/57 |
| 2014/0371334 | A1 * | 12/2014 | Steynberg | B01J 8/1827 518/700 |

FOREIGN PATENT DOCUMENTS

| | | |
|---|---|---|
| KZ | 26139 B | 9/2012 |
| RU | 2352616 | 4/2009 |
| WO | WO 2009/003634 A1 | 1/2009 |
| WO | WO 2012/055957 A2 | 5/2012 |

OTHER PUBLICATIONS

Office Action dated Mar. 30, 2017 in Kazakh Patent Application No. 2016/0064.1 (with English language translation).

Office Action as received in the corresponding Russian Patent Application No. 2016101765/04(002445) dated Apr. 6, 2018 w/English Translation.

* cited by examiner

PROCESS FOR THE REFINING OF CRUDE OIL

The present invention relates to a process for the refining of crude oil which comprises the use of a certain hydroconversion unit. More specifically, it relates to a process which allows the conversion of the feedstock to a refinery equipped with a coking unit (or visbreaking unit) to be optimized, exploiting facilities already present in the refinery, allowing its transformation into only distillates, avoiding the by-production of coke, by the insertion of a hydroconversion unit substituting the coking unit (or visbreaking unit).

Current refineries were conceived starting from demands which were generated in the last century straddling the Second World War and evolved considerably starting from the years 1950-1960 when the significant increase in the request for movability caused a rapid increase in the demand for gasoline. Two refining schemes were therefore developed, one called simple cycle scheme or Hydroskimming and a complex cycle scheme ("La raffinazione del petrolio" (Oil refining), Carlo Giavarini and Alberto Girelli, Editorial ESA 1991). In both schemes, the primary operations are the same: the crude oil is pretreated (Filtration, Desalination), then sent to the primary distillation section. In this section, the crude oil is first fed to a distillation column at atmospheric pressure (Topping) which separates the lighter distillates, whereas the atmospheric residue is transferred to a sub-atmospheric distillation column (Vacuum) which separates the heavy distillates from the vacuum residue. In the simple cycle scheme, the vacuum residue is substantially used for the production of bitumens and fuel oil. The complex cycle scheme was conceived for further converting the barrel deposit to distillates and for maximizing the production of gasoline and its octane content. Units were then added for promoting the conversion of the heavier fractions (Various Catalytic Cracking, Thermal cracking, Visbreaking, Coking technologies) together with units for promoting the production of gasoline having a maximum octane content (Fluid Catalytic Cracking, Reforming, Isomerization, Alkylation).

With respect to the period in which these schemes were conceived, there has been an enormous variation in the surrounding scenario. The increase in the price of crude oils and environmental necessities are pushing towards a more efficient use of fossil resources. Fuel oil, for example, has been almost entirely substituted by natural gas in the production of electric energy. It is therefore necessary to reduce or eliminate the production of the heavier fractions (Fuel oil, bitumens, coke) and increase the conversion to medium distillates, favouring the production of gas oil for diesel engines, whose demand, especially in Europe, has exceeded the request for gasoline. Other important change factors consist of the progressive deterioration in the quality of crude oils available and an increase in the quality of fuels for vehicles, imposed by the regulatory evolution for reducing environmental impact. The pressure of these requirements has caused a further increase in the complexity of refineries with the addition of new forced conversion technologies: hydrocracking at a higher pressure, gasification technologies of the heavy residues coupled with the use of combined cycles for the production of electric energy, technologies for the gasification or combustion of coke oriented towards the production of electric energy.

The increase in the complexity has led to an increase in the conversion efficiency, but has increased energy consumptions and has made operative and environmental management more difficult. New refining schemes must therefore be found which, although satisfying the new demands, allow a recovery of the efficiency and operative simplicity.

FIG. 1 shows a typical simplified block scheme of a coking refinery which provides for an atmospheric distillation line (Topping) (T) fed with light and/or heavy crude oils (FEED CDU).

A heavy atmospheric residue (RA) is obtained from the Topping, which is sent to the sub-atmospheric distillation column (Vacuum) (V), liquid streams (HGO), (LGO), (Kero), (WN) and gaseous streams (LPG).

A heavy residue (RV) is obtained from the Vacuum, which is sent to the Coking unit, together with two liquid streams (HVGO), (LVGO).

A heavy residue (Coke) is obtained from the Coking unit, together with three liquid streams (heavy gasoil from coking (CkHGO), Naphtha (CkN) and light gasoil from Coking (CkLGO) and a gaseous stream (Gas).

The Naphtha liquid stream (CkN) is joined with the total naphtha stream (WN) coming from the Topping, and possibly with at least part of the Naphtha from desulfurations (HDS/HDC) (HDS2) (HDS1) and fed to a desulfuration unit (HDS3) and reforming unit (REF) of naphtha with the production of Gas, C5, LPG, desulfurated naphtha (WN des) and reformed gasoline (Rif).

The heavy gasoil (CkHGO) produced from the coking unit, the HGO stream coming from the Topping and the HVGO stream coming from the Vacuum, are fed to a hydrodesulfuration or hydrocracking unit of heavy gasoils (HDS/HDC) from which two gaseous streams are obtained (Gas, $H_2S$) together with three liquid streams (Naphtha, LGO, Bottom HDS), of which the heaviest stream (Bottom HDS) is subsequently subjected to catalytic cracking (FCC) with the production of Gas, LPG and LGO.

In addition to coke, another by-product consists of the fuel oil mainly produced as bottom product of FCC (Bottom FCC) and vacuum.

The liquid stream (CkLGO) produced by the coking unit is fed to a hydrodesulfuration unit of medium gasoils (HDS2) from which two gaseous streams are obtained (Gas, $H_2S$) together with two liquid streams (Naphtha,GO des).

The liquid streams (Kero, LGO) obtained in the Topping are sent to a hydrodesulfuration unit of light gasoils (HDS1), from which two gaseous streams are obtained (Gas, $H_2S$) together with two liquid streams (Naphtha,GO des).

A coking refinery scheme has considerable problems linked not only with the environmental impact of the coke by-product, which is always more difficult to place, as also the other fuel-oil by-product, but also with production flexibility in relation to the type of crude oil. In a variable scenario of prices and availability of crude oils, it is important for a refinery to have the capacity of responding with flexibility, in relation to the characteristics of the feedstock.

In the last twenty years, important efforts have been made for developing hydrocracking technologies able to completely convert heavy crude oils and sub-atmospheric distillation residues into distillates, avoiding the coproduction of fuel oil and coke. An important result in this direction was obtained with the development of the EST technology (Eni Slurry Technology) described in the following patent applications:

IT-M195A001095, IT-M12001A001438,
IT-M12002A002713, IT-M12003A000692,
IT-M12003A000693, IT-M12003A002207,
IT-M12004A002445, IT-M12004A002446,
IT-M12006A001512, IT-M12006A001511,
IT-M12007A001302, IT-M12007A001303,
IT-M12007A001044, IT-M12007A1045,

IT-M12007A001198, IT-M12008A001061.

With the application of this technology, it is in fact possible to reach the desired total conversion result of the heavy fractions to distillates.

Figure 1:
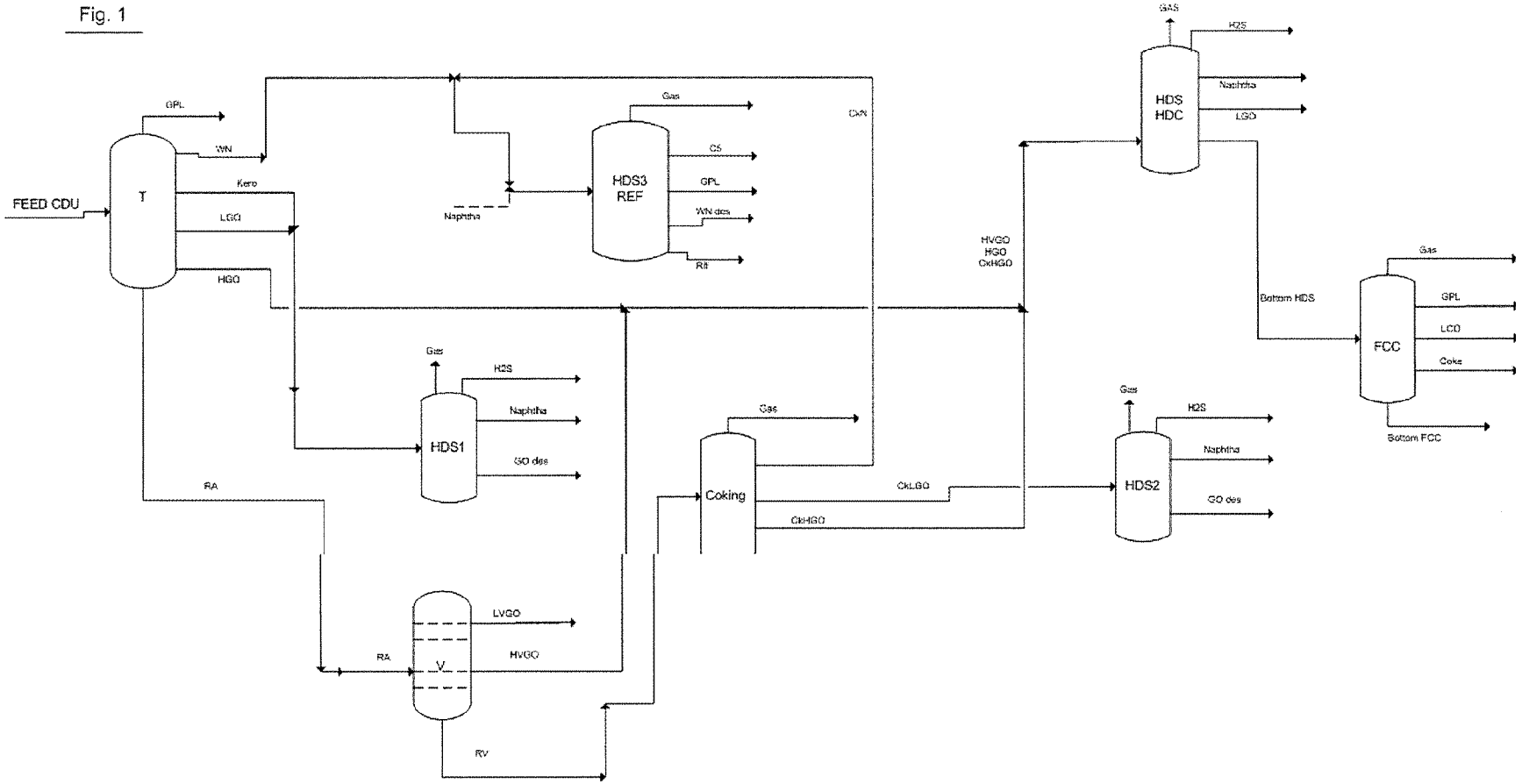
PRIOR ART Fig. 1
FIG. 1 shows a typical simplified block scheme of a coking refinery which provides for an atmospheric distillation line (Topping) (T) fed with light and/or heavy crude oils (FEED CDU).

It has now been found that, by substantially substituting the coking unit (or alternative Catalytic Cracking, thermal Cracking, Visbreaking conversion sections) with a hydroconversion section made according to said EST technology, a new refinery scheme can be obtained which, although allowing the total conversion of the crude oil, is much simpler and advantageous from an operative, environmental and economical point of view.

The application of the process claimed allows a reduction in the number of unit operations, storage tanks of the raw materials and semi-processed products and consumptions, in addition to an increase in the refining margins with respect to a modern refinery, used as reference.

Among the various schemes of the EST technology, those described in patent applications IT-MI2007A001044 and IT-MI2007A1045 are particularly recommended, which make it possible to easily operate at higher temperatures and with the production of distillates in vapour phase, giving the ex-coking refinery a high flexibility in the mixing of light and heavy crude oils. This avoids the production of coke and minimizes fuel oil, maximizing the production of medium distillates and reducing or annulling the gasoline fraction.

The use of the technology described in patent applications IT-MI2007A001044 and IT-MI2007A1045 allows the reaction temperature to be calibrated (on average by 10-20° C. more with respect to the first generation technology), in relation to the composition of the feedstock, thanks to the possibility of extracting all the products in vapour phase from the reaction section, maintaining or directly recycling the non-converted liquid fractions in the reactor. The hydrogenating gaseous mixture, fed in the form of primary and secondary stream, to the bubble column reactor, also acts as stripping agent for the products in vapour phase. This technology makes it possible to operate at high temperatures (445-450° C.), in the case of heavy crude oil mixtures, avoiding the circulation downstream, towards the vacuum unit, of extremely heavy residual liquid streams which are therefore very difficult to treat: they do in fact require high pour point temperatures which, however, lead to the undesired formation of coke, in plant volumes where there is no hydrogenating gas. Alternatively, when the scenario makes it convenient, the same plant, which can also be run at lower temperatures (415-445° C.), can also treat less heavy or lighter crude oils. This process cycle consequently allows to minimize the fraction of the 350+ cut in the products, therefore consisting of only 350−.

The EST technology, inserted in an ex-coking (or ex-visbreaking) refinery, allows optimization for producing medium distillates, by simply excluding the coking units and re-arranging/reconverting the remaining process units. The gasoline production line (FCC, reforming, MTBE, alkylation) can be alternatively kept deactivated or activated when the scenario of the market requires this, in relation to the demands for gasolines.

The process, object of the present invention, for the refining of crude oil comprises at least one atmospheric distillation unit for separating the various fractions, a sub-atmospheric distillation unit, a conversion unit of the heavy fractions obtained, a unit for enhancing the quality of some of the fractions obtained by actions on the chemical composition of their constituents and a unit for the removal of undesired components, characterized in that the sub-atmospheric distillation residue is sent to one of the conversion units, said conversion unit comprises at least one hydroconversion reactor in slurry phase, into which hydrogen or a mixture of hydrogen and $H_2S$, is fed, in the presence of a suitable dispersed hydrogenation catalyst with dimensions ranging from 1 nanometer to 30 microns.

The dispersed hydrogenation catalyst is based on Mo or W sulfide, it can be formed in-situ, starting from a decomposable oil-soluble precursor, or ex-situ and can possibly additionally contain one or more other transition metals.

A product preferably in vapour phase is obtained in the hydroconversion unit comprising at least one hydroconversion reactor, which is subjected to separation to obtain fractions in vapour phase and liquid phase.

The heavier fraction separated in liquid phase obtained in this conversion unit is preferably at least partly recycled to the sub-atmospheric distillation unit.

The process according to the invention preferably comprises the following steps:

- feeding the crude oil to one or more atmospheric distillation units in order to separate various streams;
- feeding the heavy residue(s) separated in the atmospheric distillation unit(s), to the sub-atmospheric distillation unit, separating at least two liquid streams;
- feeding the vacuum residue separated in the sub-atmospheric distillation unit to the conversion unit comprising at least one hydroconversion reactor in slurry phase in order to obtain a product in vapour phase, which is subjected to one or more separation steps obtaining fractions in both vapour phase and liquid phase, and a by-product in slurry phase;
- feeding the lighter separated fraction obtained in the sub-atmospheric distillation unit to a hydrodesulfuration unit of light gasoils (HDS1);
- feeding the liquid fraction separated in the hydroconversion unit, having a boiling point higher than 350° C., to a hydrodesulfuration and/or hydrocracking unit of heavy gasoils (HDS/HDC);
- feeding the liquid fraction separated in the hydroconversion unit, having a boiling point ranging from 170 to 350° C., to a hydrodesulfuration unit of medium gasoils (HDS2);
- feeding the liquid fraction separated in the hydroconversion unit, having a boiling point ranging from the boiling point of the $C_5$ products to 170° C., to a desulfuration unit of naphtha (HDS3);
- feeding the liquid stream separated in the atmospheric distillation unit, having a boiling point ranging from the boiling point of the $C_5$ products to 170° C., to said desulfuration unit of naphtha (HDS3).

The lighter separated fraction obtained in the sub-atmospheric distillation unit and the liquid fraction separated in the hydroconversion unit, having a boiling point ranging from 170 to 350° C., can be preferably fed to the same hydrodesulfuration unit of light or medium gasoils (HDS1/HDS2).

A reforming unit (REF) may be preferably present downstream of the desulfuration unit of naphtha (HDS3).

The streams separated in the sub-atmospheric distillation unit are preferably three, the third steam, having a boiling point ranging from 350 to 540° C., being fed to the hydrodesulfuration and/or hydrocracking unit of heavy gasoils (HDS/HDC).

The heavier fraction obtained downstream of the second hydrodesulfuration unit can be sent to a FCC unit.

The hydroconversion unit can comprise, in addition to one or more hydroconversion reactors in slurry phase from which a product in vapour phase and a slurry residue are obtained, a gas/liquid treatment and separation section, to which the product in vapour phase is sent, a separator, to which the slurry residue is sent, followed by a second separator, an atmospheric stripper and a separation unit.

The hydroconversion unit can also possibly comprise a vacuum unit or more preferably a multifunction vacuum unit, downstream of the atmospheric stripper, characterized by two streams at the inlet, of which one stream containing solids, fed at different levels, and four streams at the outlet: a gaseous stream at the head, a side stream (350-500° C.), which can be sent to a desulfuration or hydrocracking unit, a heavier residue which forms the recycled stream to the EST reactor (450+° C.) and, at the bottom, a very concentrated cake (30-33% solids). In this way, starting from two distinct feedings and in the presence of steam, the purge can be concentrated and the recycled stream to the EST reactor produced, in a single apparatus.

In addition to gases, a heavier liquid stream, an intermediate liquid stream, having a boiling point lower than 380° C., and a stream substantially containing acid water, can be obtained from the gas/liquid treatment and separation section, the heavier stream preferably being sent to the second separator downstream of the hydroconversion reactor(s) and the intermediate liquid stream being sent to the separation unit downstream of the atmospheric stripper.

A heavy liquid residue is preferably separated from a gaseous stream in the first separator, a liquid stream and a second gaseous stream are separated in the second separator, fed by the heavier liquid stream obtained in the gas/liquid treatment and separation section, the gaseous stream coming from the first separator either being joined to said second gaseous stream or fed to the second separator, both of said streams leaving the second separator being fed to the atmospheric stripper, in points at different heights, obtaining, from said atmospheric stripper, a heavier liquid stream and a lighter liquid stream which is fed to the separation unit, so as to obtain at least three fractions, of which one, the heaviest fraction having a boiling point higher than 350° C., sent to the hydrodesulfuration and/or hydrocracking unit of heavy gasoils (HDS/HDC), one, having a boiling point ranging from 170 to 350° C., one having a boiling point ranging from the boiling point of the $C_5$ products to 170° C.

If the Multifunction vacuum unit is present, both the heavy residue separated in the first separator and the heaviest liquid stream separated in the atmospheric stripper are preferably fed at different levels to said unit, obtaining, in addition to a gaseous stream, a heavier residue which is recycled to the hydroconversion reactor(s) and a lighter liquid stream, having a boiling point higher than 350° C., which is sent to the hydrodesulfuration and/or hydrocracking unit of heavy gasoils (HDS/HDC).

The hydroconversion reactor(s) used are preferably run under hydrogen pressure or a mixture of hydrogen and hydrogen sulfide, ranging from 100 to 200 atmospheres, within a temperature range of 400 to 480° C.

The present invention can be applied to any type of hydrocracking reactor, such as a stirred tank reactor or preferably a slurry bubbling tower. The slurry bubbling tower, preferably of the solid accumulation type (described in the above patent application IT-MI2007A001045), is equipped with a reflux circuit whereby the hydroconversion products obtained in vapour phase are partially condensed and the condensate sent back to the hydrocracking step. Again, in the case of the use of a slurry bubbling tower, it is preferable for the hydrogen to be fed to the base of the reactor through a suitably designed apparatus (distributor on one or more levels) for obtaining the best distribution and the most convenient average dimension of the gas bubbles and consequently a stirring regime which is such as to guarantee conditions of homogeneity and a stable temperature control even when operating in the presence of high concentrations of solids, produced and generated by the charge treated, when operating in solid accumulation. If the asphaltene stream obtained after separation of the vapour phase is subjected to distillation for the extraction of the products, the extraction conditions must be such as to reflux the heavy cuts in order to obtain the desired conversion degree.

The preferred operating conditions of the other units used are the following:

- for the hydrodesulfuration unit of light gasoils (HDS1) temperature range from 320 to 350° C. and pressure ranging from 40 to 60 kg/cm$^2$, more preferably from 45 to 50 kg/cm$^2$;
- for the hydrodesulfuration unit of medium gasoils (HDS2) temperature range from 320 to 350° C. and pressure ranging from 50 to 70 kg/cm$^2$, more preferably from 65 to 70 kg/cm$^2$;
- for the hydrodesulfuration or hydrocracking unit of heavy gasoils (HDS/HDC) temperature range from 310 to 360° C. and pressure ranging from 90 to 110 kg/cm$^2$;
- for the desulfuration unit (HDS3) temperature range from 260 to 300° C. and naphtha reforming unit (REF) temperature range from 500 to 530° C.

Figure 2:
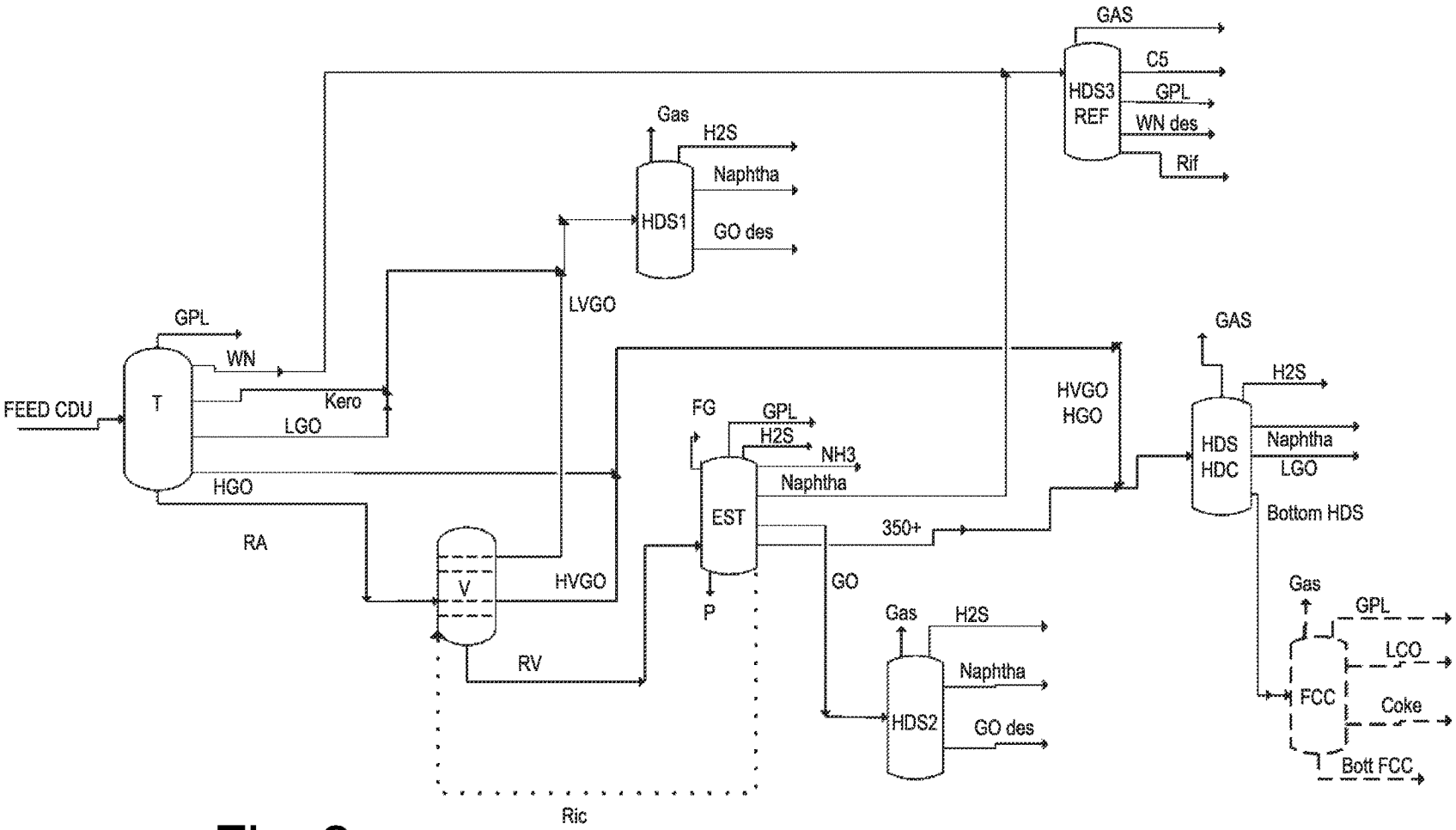
FIG. 2 illustrates the refinery scheme based on the EST technology in which substantially the coking unit of the scheme of FIG. 1 is substituted by the hydroconversion unit (EST).
Figure 3:
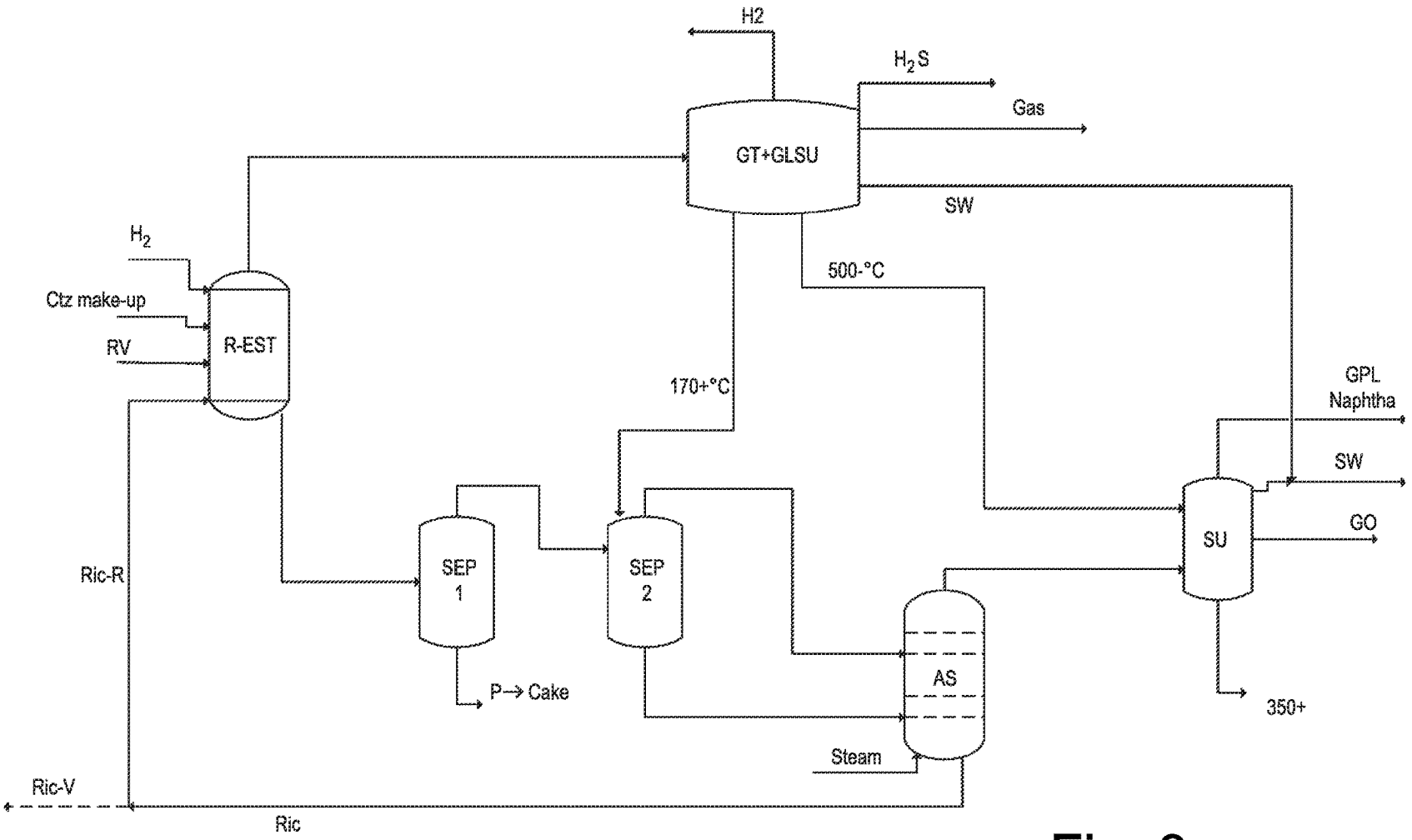
FIG. 3 illustrates an alternative detailed schemes for the hydroconversion unit (EST) used in FIG. 2 in which the substantial difference relates to the absence of the Multi-function Vacuum unit.
Figure 4:
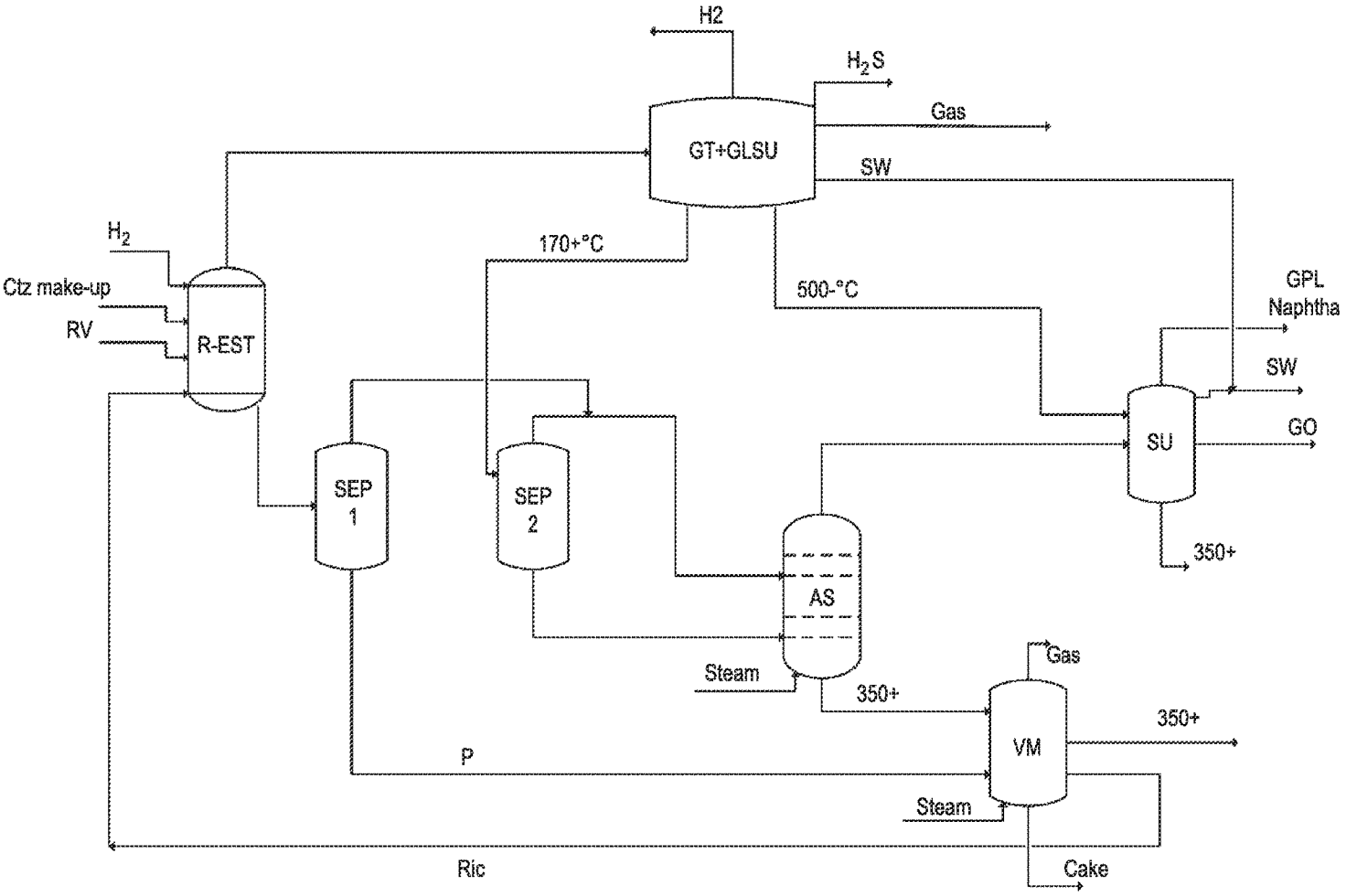
FIG. 4 illustrates an alternative detailed schemes for the hydroconversion unit (EST) used in FIG. 2 in which the substantial difference relates to the presence of the Multi-function Vacuum unit.

Some preferred embodiments of the invention are now provided, with the help of the enclosed FIGS. 2-4, which should not be considered as representing a limitation of the scope of the invention itself.

FIG. 2 illustrates the refinery scheme based on the EST technology in which substantially the coking unit of the scheme of FIG. 1 is substituted by the hydroconversion unit (EST).

Other differences consist in sending the LVGO stream leaving the Vacuum (V) to the hydrodesulfuration section (HDS1).

A purge (P) is extracted from the hydroconversion unit (EST), whereas a fuel gas stream (FG) is obtained, together with an LPG stream, a stream of $H_2S$, a stream containing $NH_3$, a Naphtha stream, a gasoil stream (GO) and a stream having a boiling point higher than 350° C. (350+).

Part of the heavier fraction obtained can be recycled (Ric) to the Vacuum (V).

The stream GO is fed to the hydrodesulfuration unit of the medium gasoils (HDS2).

The 350+ stream is fed to the hydrodesulfuration or hydrocracking unit of the heavy gasoils (HDS/HDC).

The Naphtha stream is fed to the desulfuration unit (HDS3) and naphtha reforming unit (REF).

FIG. 3 and FIG. 4 illustrate two alternative detailed schemes for the hydroconversion unit (EST) used in FIG. 2 in which the substantial difference relates to the absence (FIG. 3) or presence (FIG. 4) of the Multifunction Vacuum unit.

In FIG. 3, the vacuum residue (RV), $H_2$ and the catalyst (Ctz make-up) are sent to the hydroconversion reactor(s) (R-EST). A product in vapour phase is obtained at the head, which is sent to the gas/liquid Treatment and Separation section (GT+GLSU). This section allows the purification of the outgoing gaseous stream and the production of liquid streams free of the 500+ fraction (three-phase separator bottom). The liquid streams proceed with the treatment in the subsequent liquid separation units whereas the gaseous streams are sent to gas recovery (Gas), hydrogen recovery ($H_2$) and $H_2S$ abatement ($H_2S$).

A heavy residue is obtained at the bottom of the reactor, which is sent to a first separator (SEP 1), whose bottom product forms the purge (P), which will generate the cake, whereas the stream at the head is sent to a second separator (SEP 2), also fed by the heavier liquid stream (170+), (having a boiling point higher than 170° C.), obtained in the gas/liquid Treatment and Separation section, separating two streams, one gaseous, the other liquid, both sent, in points at different heights, to an atmospheric stripper (AS) operated with Steam.

A stream (Ric) leaves the bottom of said stripper, which is recycled to the reactor(s) (Ric-R) and/or to the Vacuum column (Ric-V) and a stream leaves the head, which is sent to a separation unit (SU) also fed by another liquid stream (500−), having a boiling point lower than 500° C., obtained in the gas/liquid Treatment and Separation section.

The (350+), Gasoil, Naphtha, LPG, acid water streams (SW) are obtained from said Separation Unit (SU).

In FIG. 4, the heavy residue is sent again to a first separator (SEP 1), whose bottom product is sent to a Multifunction Vacuum unit (VM), whereas only the heavier stream obtained in the gas/liquid Treatment and Separation section is sent to the second separator (SEP 2). Two streams are obtained from the second separator, of which the heavier stream is joined with the lighter stream separated in the first separator, which are both fed to the atmospheric stripper in points at different heights.

Whereas the head stream separated from the atmospheric stripper is sent to the Separation Unit as in the previous scheme, the bottom stream is fed to the Multifunction Vacuum unit (VM).

A gaseous stream (Gas) is obtained from said unit, together with a liquid stream having a boiling point higher than 350° C. (350+), a heavier stream (Ric), which is recycled to the hydroconversion reactor, in addition to a purge in the form of a cake.

EXAMPLES

Some examples are provided hereunder, which help to better define the invention without limiting its scope. A real complex-cycle modern refinery, optimized over the years for reaching the total conversion of the feedstock fed, has been taken as reference.

The optimization of the objective function was effected for each scheme analyzed, intended as the difference between the revenues obtained by introducing the products onto the market—$\Sigma(P_i*W_i)$—and the costs relating to the purchasing of the raw material—$\Sigma(C_{RM}*W_{RM})$ $$\text{Obj. Func.}=\Sigma(P_i*W_i)-\Sigma(C_{RM}*W_{RM})$$

Wherein:

$P_i$ and $W_i$ are the prices and flow-rates of the products leaving the Refinery;

$C_{RM}$ and $W_{RM}$ are the costs (€/ton) and flow-rates (ton/m) of the raw materials.

In order to have a better use and more effective reading of the response of the model, an index has been defined—EPI—Economic Performance Index, as the ratio between the value of the objective function, of each single case, with respect to a base case (Base Case), selected as reference, multiplied by 100.

$$EPI = \frac{[Obj.Func.(i)]*100}{[Obj.Func.(\text{Base Case})]}$$

The base case selected is that which represents the Refinery in its standard configuration.

Table 1 provides, for a feedstock of 25° API (3.2% S) and maximizing the total refinery capacity, a comparison between the reference base case in which naphtha, gasoil, gasoline and coke are produced, the case in which the EST technology substitutes coking (coke and gasoline are zeroed), and the case in which medium distillates and also gasoline are produced. It can be observed that the economic advantage progressively increases (see EPI, Economic Performance Index). The table also indicates the yields that can be obtained when the refinery capacity is maximum (100%).

Table 2 indicates, for a heavier feedstock (23° API and 3.4 S) and maximizing the total refinery capacity, the effect on the refinery cycle. Also in this case, an improvement due to the insertion of EST is confirmed.

Table 3 indicates, for an even heavier feedstock (21° API and 3.6% S), the case in which the EST capacity is limited to a plant with two reaction lines. The effect is always advantageous with respect to the case with coking. Even if the refinery capacity is not maximum (81.8%), the EPI value is higher than the standard case of Table 1, thanks to the insertion of EST (101%) and EST+FCC (109%).

Table 4 indicates, for a feedstock of 21° API and 3.6% S, the case in which the improving effect for EST is increased if the heavier fraction produced by EST (see FIG. 3) is recycled to the existing refinery vacuum. For a reduced refinery capacity, the economic value sees EPI increasing from 111% to 119% for EST and EST+FCC respectively.

TABLE 1

| Full Crude mix Refinery capacity = 100% | | | Base Case 100.00 (1) | EST 144.36 | EST + FCC 159.44 |
|---|---|---|---|---|---|
| API | % SUL | EPI* Products | % wt on crude feed | % wt on crude feed | % wt on crude feed |
| 24.54 | 3.18 | LPG | 3.75 | 1.86 | 4.31 |
| | | Naphtha | 10.20 | 15.20 | 15.81 |
| | | Gasoline | 21.58 | 0.00 | 12.32 |
| | | Gas oil | 44.01 | 50.36 | 57.14 |
| | | Coke | 16.31 | 0.00 | 0.00 |
| | | Sulfur/H2SO4 | 4.15 | 6.23 | 6.53 |
| | | C5 | 0.00 | 3.09 | 3.06 |

TABLE 1-continued

| Full Crude mix Refinery capacity = 100% | | | Base Case 100.00 (1) | EST 144.36 | EST + FCC 159.44 |
|---|---|---|---|---|---|
| API | % SUL | EPI* Products | % wt on crude feed | % wt on crude feed | % wt on crude feed |
| | | Purging EST | 0.00 | 0.58 | 0.62 |
| | | Bottom HDS | 0.00 | 22.49 | 0.00 |
| | | NH3 | 0.00 | 0.19 | 0.20 |

(1) Base Case: STD refinery configuration with Full Mix feed of crude oils and maximum capacity

*Economic Performance Index intended as % variation of the Obj. Func. with respect to the base case (1)

TABLE 2

| Heavy Crude Mix Refinery capacity = 100% | | | Base Case 116.91 | EST 137.65 | EST + FCC 160.34 |
|---|---|---|---|---|---|
| API | % SUL | EPI* Products | % wt on crude feed | % wt on crude feed | % wt on crude feed |
| 23.35 | 3.37 | LPG | 3.51 | 1.65 | 4.25 |
| | | Naphtha | 10.55 | 13.60 | 13.81 |
| | | Gasoline | 19.70 | 0.00 | 13.65 |
| | | Gas oil | 44.38 | 48.54 | 57.73 |
| | | Coke | 17.58 | 0.00 | 0.00 |
| | | Sulfur/H2SO4 | 4.28 | 6.24 | 6.72 |
| | | C5 | 0.00 | 2.39 | 2.85 |
| | | Purging EST | 0.00 | 0.74 | 0.80 |
| | | Bottom HDS | 0.00 | 26.66 | 0.00 |
| | | NH3 | 0.00 | 0.19 | 0.20 |

*Economic Performance Index intended as % variation of the Obj. Func. with respect to the base case (1)

TABLE 3

| Heavy Crude Mix EST conf. without recyc. to Vacuum Refinery capacity = 81.8% | | | Base Case 75.73 | EST 101.32 | EST + FCC 109.03 |
|---|---|---|---|---|---|
| | | EPI* Products | % wt on crude feed | % wt on crude feed | % wt on crude feed |
| API | % SUL | LPG | 3.36 | 1.58 | 4.39 |
| 21.21 | 3.58 | Naphtha | 7.90 | 13.81 | 14.11 |
| | | Gasoline | 22.08 | 0.00 | 14.31 |
| | | Gas oil | 45.85 | 48.07 | 56.25 |
| | | Coke | 15.68 | 0.00 | 0.00 |
| | | Sulfur/H2SO4 | 3.10 | 6.69 | 7.00 |
| | | C5 | 2.03 | 2.81 | 2.99 |
| | | Purging EST | 0.00 | 0.70 | 0.75 |
| | | Bottom HDS | 0.00 | 26.16 | 0.00 |
| | | NH3 | 0.00 | 0.18 | 0.19 |

*Economic Performance Index intended as % variation of the Obj. Func. with respect to the base case (1)

TABLE 4

| Heavy Crude Mix EST conf. without recyc. to Vacuum Refinery capacity = 81.8% | | | Base Case 75.73 | EST 101.32 | EST + FCC 109.03 |
|---|---|---|---|---|---|
| | | EPI* Products | % wt on crude feed | % wt on crude feed | % wt on crude feed |
| API | % SUL | LPG | 3.36 | 1.58 | 4.39 |
| 21.21 | 3.58 | Naphtha | 7.90 | 13.81 | 14.11 |
| | | Gasoline | 22.08 | 0.00 | 14.31 |

TABLE 4-continued

| Heavy Crude Mix EST conf. without recyc. to Vacuum Refinery capacity = 81.8% | | Base Case 75.73 | EST 101.32 | EST + FCC 109.03 |
|---|---|---|---|---|
| | EPI* Products | % wt on crude feed | % wt on crude feed | % wt on crude feed |
| | Gas oil | 45.85 | 48.07 | 56.25 |
| | Coke | 15.68 | 0.00 | 0.00 |
| | Sulfur/H2SO4 | 3.10 | 6.69 | 7.00 |
| | C5 | 2.03 | 2.81 | 2.99 |
| | Purging EST | 0.00 | 0.70 | 0.75 |
| | Bottom HDS | 0.00 | 26.16 | 0.00 |
| | NH3 | 0.00 | 0.18 | 0.19 |

*Economic Performance Index intended as % variation of the Obj. Func. with respect to the base case (1)

The invention claimed is:

1. A process for refining of crude oil, the process comprising:

feeding the crude oil to one or more atmospheric distillation units in order to separate at least a heavy residue(s);

feeding the heavy residue(s) separated in the atmospheric distillation unit(s), to a sub-atmospheric distillation unit, separating at least two liquid streams, which are a vacuum residue and a light separated fraction;

feeding the vacuum residue separated in the sub-atmospheric distillation unit to a conversion unit comprising at least one hydroconversion reactor in slurry phase into which hydrogen or a mixture of hydrogen and $H_2S$ is fed in the presence of a dispersed hydrogenation catalyst with a dimension ranging from 1 nanometer to 30 microns to obtain a product in vapour phase and a by-product in slurry phrase, wherein the product in vapour phase is treated in a gas-liquid treatment unit and separated in a separation unit thereby obtaining fractions in both vapour phase and liquid phase;

feeding the light separated fraction obtained in the sub-atmospheric distillation unit to a hydrodesulfurization unit of light gasoils (HDS1);

feeding a liquid fraction separated in the conversion unit, having a boiling point higher than 350° C., to a hydrodesulfurization and/or hydrocracking unit of heavy gasoils (HDS/HDC);

feeding a liquid fraction separated in the conversion unit, having a boiling point ranging from 170 to 350° C., to a hydrodesulfurization unit of medium gasoils (HDS2);

feeding a liquid fraction separated in the conversion unit, having a boiling point ranging from the boiling point of the $C_5$ products to 170° C., to a desulfurization unit of naphtha (HDS3);

feeding a light separated fraction separated in the atmospheric distillation unit(s), having a boiling point ranging from the boiling point of the $C_5$ products to 170° C., to said desulfurization unit of naphtha (HDS3), wherein the conversion unit comprises, in addition to one or more hydroconversion reactors in slurry phase, a first separator, to which the slurry residue is sent, followed by a second separator, an atmospheric stripper and a separation unit downstream said stripper, and wherein in addition to the conversion reaction, the following steps occur:

separating the by-product in slurry phase in a first separator forming a bottom product and a head product, separating the head product in a second separator also fed by a liquid stream having a boiling point higher than 170° C. obtained in the gas-liquid treatment and separation section, forming a liquid and gaseous stream both sent in points at different heights to the atmospheric stripper, and stripping in the atmospheric stripper using steam said liquid and gaseous stream separated in the second separator; wherein a stream leaving the bottom of the atmospheric stripper is recycled to the conversion unit and/or to the sub-atmospheric distillation unit, and obtaining from the stripper a heavy liquid stream and a light liquid stream which is fed to the separation unit together with the liquid stream having a boiling point lower than 500° C. and obtained in the gas-liquid treatment and separation section so as to separate at least three fractions: a fraction having a boiling point higher than 350° C., the liquid fraction having a boiling point ranging from 170° C. to 350° C. and the liquid fraction having a boiling point ranging from the boiling point of C5 products to 170° C.

2. The process according to claim 1, wherein a heavy fraction separated in liquid phase obtained in the conversion unit comprising at least one conversion reactor is at least partly recycled to the sub-atmospheric distillation unit.

3. The process according to claim 1, wherein the light separated fraction obtained in the sub-atmospheric distillation unit and the liquid fraction separated in the conversion unit, having a boiling point ranging from 170 to 350° C., are fed to the same hydrodesulfurization unit of light or medium gasoils (HDS1/HDS2).

4. The process according to claim 1, wherein a reforming unit (REF) is present downstream of the desulfurization unit of naphtha (HDS3).

5. The process according to claim 1, wherein three streams are separated in the sub-atmospheric distillation unit, the third steam, having a boiling point ranging from 350 to 540° C., being fed to the hydrodesulfurization and/or hydrocracking unit of heavy gasoils (HDS/HDC).

6. The process according to claim 1, wherein a heavy fraction obtained downstream of the hydrodesulfurization and/or hydrocracking unit of heavy gasoils (HDS/HDC) is sent to a FCC unit (FCC).

7. The process according to claim 1, wherein gases, a heavy liquid stream, an intermediate liquid stream, having a boiling point lower than 380° C., and a stream containing acid water, are obtained from the gas-liquid treatment unit and separation section, the heavy stream being sent to the second separator downstream of the hydroconversion reactor(s) and the intermediate liquid stream being sent to the separation unit downstream of the atmospheric stripper.

8. The process according to claim 1, wherein a nano-dispersed catalyst is based on molybdenum.

9. A process for refining of crude oil, the process comprising:

feeding the crude oil to one or more atmospheric distillation units in order to separate at least a heavy residue(s);

feeding the heavy residue(s) separated in the atmospheric distillation unit(s), to a sub-atmospheric distillation unit, separating at least two liquid streams, which are a vacuum residue and a light separated fraction;

feeding the vacuum residue separated in the sub-atmospheric distillation unit to a conversion unit comprising at least one conversion reactor in slurry phase into which hydrogen or a mixture of hydrogen and $H_2S$ is fed in the presence of a dispersed hydrogenation catalyst with dimension ranging from 1 nanometer to 30 microns in order to obtain a product in vapour phase and a by-product in slurry phase, wherein said product in vapor phase is treated in a gas-liquid treatment unit and separated in a separation section obtaining fractions in both vapour phase and liquid phase;

feeding a light separated fraction obtained in the sub-atmospheric distillation unit to a hydrodesulfurization unit of light gasoils (HDS1);

feeding a liquid fraction separated in the conversion unit, having a boiling point higher than 350° C., to a hydrodesulfurization and/or hydrocracking unit of heavy gasoils (HDS/HDC);

feeding a liquid fraction separated in the conversion unit, having a boiling point ranging from 170 to 350° C., to a hydrodesulfurization unit of medium gasoils (HDS2);

feeding a liquid fraction separated in the conversion unit, having a boiling point ranging from the boiling point of the $C_5$ products to 170° C., to a desulfurization unit of naphtha (HDS3);

feeding a liquid stream separated in the atmospheric distillation unit(s), having a boiling point ranging from the boiling point of the $C_5$ products to 170° C., to said desulfurization unit of naphtha (HDS3), wherein the conversion unit comprises, in addition to one or more conversion reactors in slurry phase, a first separator, to which the slurry residue is sent, followed by a second separator, an atmospheric stripper and a separation unit downstream said stripper, and wherein in addition to the conversion reaction, the following steps occur:

separating the by-product in slurry phase in a first separator, forming a bottom product and a head product, separating said head product in a second separator, also fed by a liquid stream having a boiling point higher than 170° C. obtained in the gas-liquid treatment and separation section, forming a liquid and gaseous stream both sent in points at different heights to an atmospheric stripper; and stripping in the atmospheric stripper using steam said liquid and gaseous stream separated in the second separator; wherein a stream leaving the bottom of the atmospheric stripper is recycled to the conversion unit and/or to the sub-atmospheric distillation unit, and obtaining from said stripper a heavy liquid stream and a light liquid stream which is fed to the separation unit together with a liquid stream having a boiling point lower than 500° C. and obtained in the gas-liquid treatment and separation section, so as to separate at least three fractions: the fraction having a boiling point higher than 350° C., the stream having a boiling point ranging from 170° C. to 350° C. and the stream having a boiling point ranging from the boiling point of C5 products to 170° C.

* * * * *